United States Patent [19]

Lázár

[11] Patent Number: 4,674,932

[45] Date of Patent: Jun. 23, 1987

[54] BINDING EQUIPMENT

[75] Inventor: Peter Lázár, Tannenstr. 11, D-4040 Neuss 21, Fed. Rep. of Germany

[73] Assignee: Peter Lazar, Neuss, Fed. Rep. of Germany

[21] Appl. No.: 850,544

[22] Filed: Apr. 11, 1986

[30] Foreign Application Priority Data

Apr. 18, 1985 [DE] Fed. Rep. of Germany ... 8511499[U]

[51] Int. Cl.[4] ..... B42B 5/00; B42C 9/00

[52] U.S. Cl. ..... 412/33; 281/21 R; 412/900

[58] Field of Search ..... 156/486, 908; 281/21 R; 412/4, 6, 8, 10, 16, 33, 37, 900, 902

[56] References Cited

U.S. PATENT DOCUMENTS

| | | | |
|---|---|---|---|
| 3,261,044 | 7/1966 | Hoff | 412/37 X |
| 3,321,786 | 5/1967 | Bolick, Jr. | 412/37 X |
| 3,460,173 | 8/1969 | Stuertz | 412/37 X |
| 3,518,143 | 6/1970 | Führ | 412/6 |
| 3,788,921 | 1/1974 | Polit et al. | 412/37 X |
| 4,150,453 | 4/1979 | Vaughn | 412/900 |

*Primary Examiner*—Paul A. Bell

*Attorney, Agent, or Firm*—Shlesinger, Arkwright, Garvey & Fado

[57] ABSTRACT

Binding equipment is disclosed which binds loose sheets in covers which have thermoplastic adhesive at their backs to bind the sheets when such adhesive is heated. The equipment has two mutually spaced and parallel support walls to support the loose sheets within the covers. One of the walls is fixed and the other is movable within the frame supporting the walls. A support for the back of the cover is provided underneath the movable wall. This support is provided with a heater to activate the thermoplastic adhesive. The carriage mounting the movable wall moves along a displacement plane which slants upwards towards the fixed support wall.

20 Claims, 2 Drawing Figures

BINDING EQUIPMENT

Figure 1:
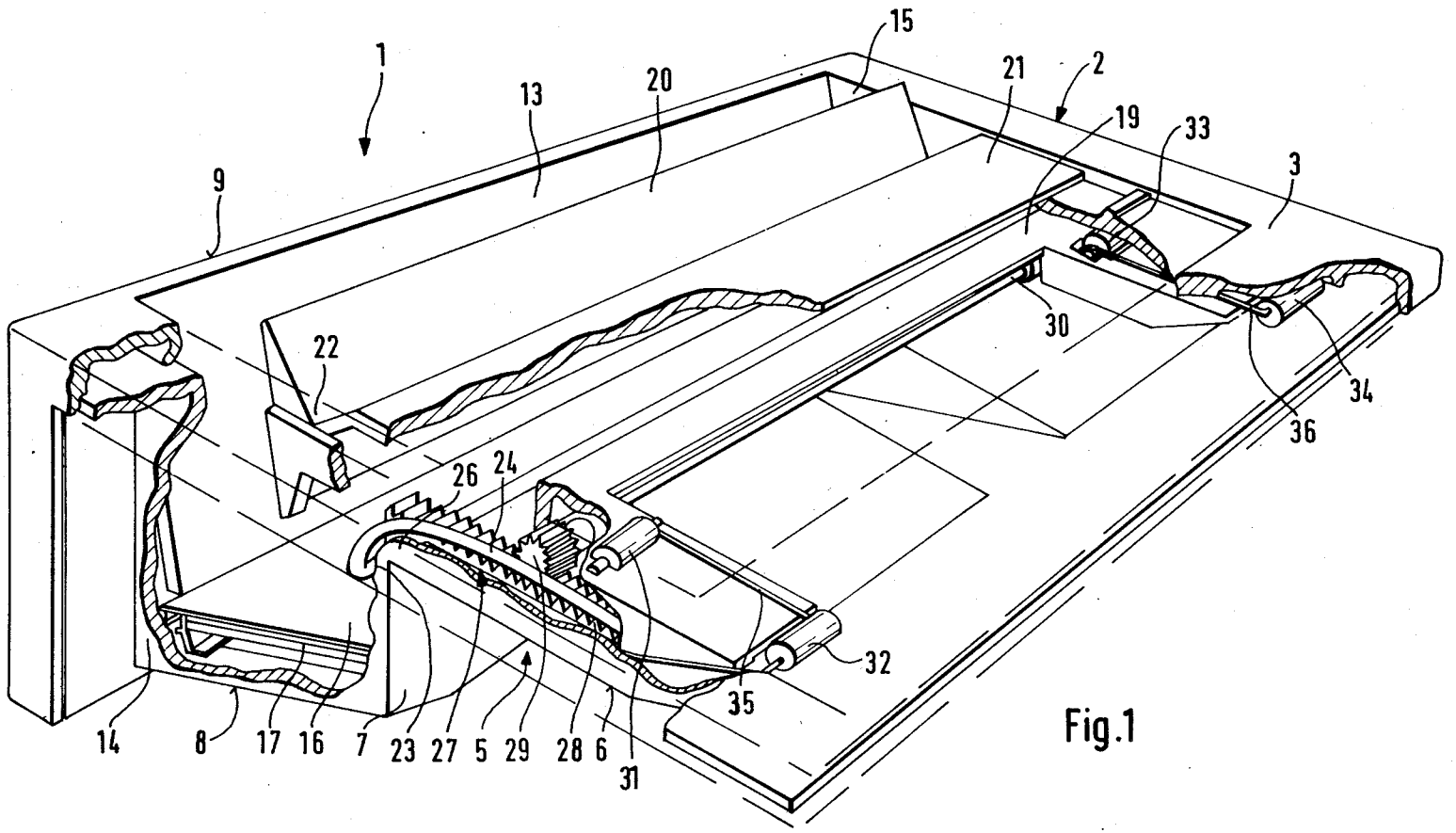

The invention concerns binding equipment to bind loose sheets into covers provided on their back with a thermoplastic adhesive, where this equipment is provided with two spaced and mutually parallel support walls of which one is connected to a carriage element displaceable within the frame, a set-up, i.e. a cover-receiving surface equipped with a heater being mounted underneath the region of the movable support wall.

Such binding equipment illustratively is described in the German Offenlegungsschrift No. 27 43 685. It includes a frame in the form of a box-like base continued at the rear into an upright support wall. A carriage element is supported in horizontally displaceable manner at the top side of the frame. The carriage element is bent upward at its edge adjacent to the first support wall into a further support wall, this support wall extending parallel to the first one and being of the same height. Accordingly, the support wall connected with the carriage element is displaceable toward or away from the first support wall, both support walls maintaining their parallel position. Two horizontal pairs of rollers enclose the carriage element on each side and assume its guidance.

A set-up surface equipped with a heater is mounted underneath the region of adjustment of the displaceable support wall. The covers are vertically placed by their backs on this set-up surface so that the thermoplastic or hot-melt adhesive mounted on the inside of the back can be heated. The particular cover is pressed by the displaceable support wall against the fixed one so that the cover retains its vertical position during heating. Because of the heating, the thermoplastic adhesive on the back inside will soften, whereby the sheets of paper laid inside the cover penetrate by their lower edges into the adhesive and are wetted there. After a given and predetermined time, the cover is removed from the binding equipment; the displaceable carriage element is retracted for that purpose. When the thermoplastic adhesive cools, solid binding of the sheets of paper in the cover has been achieved.

The above known equipment is difficult to handle because the particular cover, together with the accumulated sheets of paper therein, must be raised, when the binding equipment is operational, above one of the two support walls. This is an impediment, especially when the equipment is used as a table next to a work station—and it is used very often in that manner—with the work being carried out by a seated operator. On the other hand, it is impossible to lower the support walls as the rest of the cover required to heat its back would be degraded.

Therefore it is the object of the invention to so design and structure binding equipment of the initially cited kind that it shall be easier to insert a cover from the front between the two support walls and to remove it again.

The invention solves this problem in that the displacement element rests on a displacement plane rising toward the support walls. The angle of rise of the displacement plane, in particular, is between 15° and 45°, appropriately between 20° and 30°.

Because of the sloping plane of displacement, the height of the upper edge of the displaceable support wall is substantially less in the retracted position of the carriage element, that is in the open position, than after the displacement of the movable support wall toward the fixed one for the purpose of clamping a cover inserted in the duct between the two support walls. It is possible therefore, when in the open position, to insert more conveniently a cover over this upper edge of the movable support wall into the duct without thereby adversely affecting the ensuing clamping process. To clamp the cover, the movable support wall must be advanced, being simultaneously raised in such a manner that the cover shall be reliably held in place. The particular cover then will be better supported, i.e. higher, the less its own stability, because the movable support wall is advanced further in the case of thin covers, and thereby is raised further than in the case of thick and therefore stronger covers. Accordingly, a sloping plane of displacement for the carriage element meets very well all the practical requirements in the operation of the binding equipment of the invention.

Additionally, the sloping plane of displacement reduces the set-up surface of the binding equipment.

In an especially appropriate design of the invention, the height of the upper edge of the displaceable support wall is approximately the same as the height of the fixed support wall when both touch, that is, the upper edges of the two support walls when mutually touching are approximately at the same height, while the upper edge of the movable support wall shall be less the wider the duct above the set-up surface.

Another feature of the invention provides that a compressing element is movably guided on the carriage element and extends by its lower side almost above the set-up surface, being parallel to and below the movable support wall and being so guided on the carriage element that upon the latter's displacement, i.e. that of the movable support wall, the compression element moves by its lower side parallel and hence at a constant spacing to the set-up surface. Where needed, this compression element assures that when displacing the movable support wall toward the fixed one, the lower edge of the movable support wall shall also be lifted. Due to its additional rest on the lower part, the compression element improves stability, especially where thin covers are involved.

An advantageous embodiment of the compression element consists in designing it as a compression bail pivotably supported on both sides of the carriage element by means of guide bars. A raised housing edge or roller supports each slightly upward bent guide bar. As a result, the compression bail will move parallel to the set-up surface when the carriage element is being moved.

Additionally, the guide bars are provided with one projection each at their lower sides which, in the fully retracted position of the movable support wall, move onto their rests. Thereby, the compression bail is raised off the hot set-up surface for the case of the open position so it can no longer be heated. Also, the guide bars are appropriately loaded downward by a spring.

The upward sloping plane of displacement of the carriage element requires especially accurate guidance. The invention proposes in this respect that the carriage element be guided by at least one gear-rack means consisting in each case of one rack extending in the direction of displacement and at least one gear meshing with it. Two alternative concrete solutions suggest themselves. On one hand, the rack and the gear may be very wide and in that case can be mounted centrally so that the engagement of rack and gear shall prevent slewing by the carriage element. On the other hand, one gear-rack means may be mounted on each side of the carriage element, in which case there would be two gears each time being rigidly connected to each other and mounted pairwise at the same height. In the latter case, the rack guides may be relatively narrow and compact. The rigid coupling of the gears practically eliminates any slewing.

The rack(s) can be fixed in place and the gear(s) then can be supported in the slide element. However, an inverse arrangement may also be appropriate.

Appropriately, furthermore, the gear-rack guide(s) will be mounted to the lower side of the carriage element which thereby can rest by its base on the gear-rack guide(s).

To prop the carriage element against a downward tipping of the front part, a further gear obviously may be provided in each case which rolls on the gear-rack and which is mounted, as seen in the direction of displacement, either in front or behind the first gear. However, a more economical solution is provided by at least one support roller moving on each support track parallel to the direction of displacement. Appropriately, at least one support roller and at least one support track shall be provided on each side of the carriage element, as thereby the guidance is made still more accurate.

The invention further provides for supporting the support roller(s) by spring(s) and that the carriage element under the unhampered action of the spring-supported support rollers rests by means of at least one brake element against a housing part. Accordingly, the carriage element cannot move on its own, rather, after being actuated, it shall remain in the position once assumed. This is especially important for positions at which the movable support wall rests against the cover in order to clamp the latter tight. The geometry may be so selected that the tipping of the carriage element, and hence the spring-action loading of the support roller(s) required for the braking element to rest against the housing part, is enhanced by the movable support wall resting against the cover back, whereby the braking is reinforced. The braking effect can be lifted in a simple manner by applying a downward force to the carriage element before it is displaced, so that it is easily tipped in such a manner that the brake element heretofore resting against the housing part now detaches from it. As downward forces are present anyway when actuating the carriage, the above process takes place quasiautomatically during that actuation.

The support roller(s) appropriately will be mounted to the upper side and the brake element(s) at the lower side of the carriage element and in each case to its rear part. This is an especially advantageous design for the above described operation.

In another feature of the invention, two support rollers are provided in front of and behind each gear, as seen in the direction of displacement. As a result, the precise guidance of the carriage element is improved further, the particular two support rollers preferably being arranged to allow the above described tipping of the carriage element. These support rollers should all be mounted to the upper or to the lower side.

The invention is shown in further detail in the drawing in relation to an illustrative embodiment.

Figure 2:
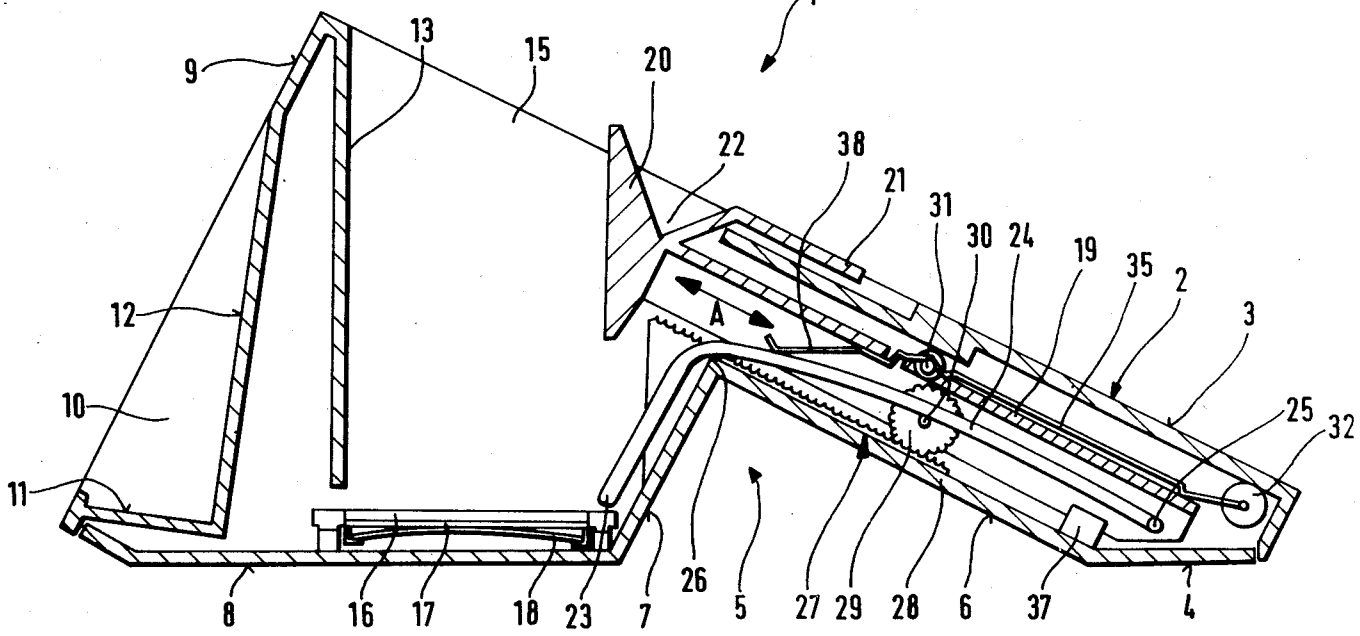

FIG. 1 is a perspective with portions broken away of the binding equipment, and FIG. 2 is a vertical section of the binding equipment of FIG. 1.

The binding equipment 1 shown in the Figures comprises a basically desk-shaped housing 2 with an upwardly slanting top side 3. Seen from the front, the lower side first includes a housing section 4 with a cut-out 5. This cut-out 5 is bounded by a housing section 6 which slants upward and extends parallel to the top side 3, and further by an orthogonally dropping housing section 7. Next, there is a horizontal housing section 8 which slightly tips upward at its rear end. The back side of the housing 2 rises obliquely in space but orthogonally to the top side 3, a recess 10 being formed into the rear side 9 to receive the binding covers after the thermoplastic adhesive on the inside of the binding cover has been heated so that the adhesive may cool and so the sheets of paper may be solidly bonded to the cover. To prevent them from falling over, the rest surface 11 of the recess 10 slightly leans inward. Accordingly, the back wall 12 of the recess 10 slants upwards.

A support wall 13 extends vertically downward from approximately the junction between the back side 9 and the top side 3 of the housing 2. The support wall 13 is joined at its side edges with the local side walls 14, 15 of the housing 2. Its lower edge terminates shortly above a receiving or set-up surface 16 extending from there toward the front and mounted to the inside of the horizontal housing section 8 of the housing 2. The set-up surface 16 is provided on its lower side with a heating plate 17 areally compressed by a curved washer spring 18. The heating plate 17 is a conventional resistance heater and connected to a power source.

An elongated carriage element 19 is supported in the front part of the housing 2 between the top side 3 and the horizontal and the upwardly slanting housing sections 4, 6; the left part of this element, as shown in this view, merges into a support wall 20 corresponding to the fixed support wall 13. The support wall 20 is displaceable with the carriage element 19 in the directions of the double arrow A, namely parallel to the upwardly slanting top side 3 of the housing 2. The carriage element 19 comprises a section 21 starting from the rear side of the support wall 20 and partly enclosing the top side of the housing 2. In that region the top side 3 is provided with a recess entered by the section 21, whereby, in the position shown, this section 21 projects only slightly above the top side 3. A recess 22 is present between the rear side of the support wall 20 and the section 21 to be entered, as called for by the operator's fingers, to displace the carriage element 19 and hence the support wall 20.

The upper edge of the movable support wall 20 slightly projects above the contour of the housing 2 formed by the top side 3. When the support wall 20 rests against the fixed support wall 13, the upper edge of the housing and the upper edge of the support wall 20 are at approximately the same height. The lower edge of the movable support wall 20, compared to the lower edge of the fixed support wall 13, is relatively far from the set-up surface 16. If now a cover with the sheets of paper held therein is placed into the gap between the two support walls, 13, 20 and this with the binding back resting on the set-up surface 16, then the cover will be compressed by the movable support wall 20 only in the upper region against the fixed support wall 13 and be held in place by it. In order to reliably support and hold in place such an inserted binding also in the areas adjoining its back, provision is made for a compression bail 23. This compression bail 23 extends precisely underneath the lower edge of the movable support wall 20 and parallel to it and in the immediate vicinity of the set-up surface 16.

The compression bail 23 is bent upwardly at its two lateral ends into guide bars 24 which initially slant upward and then in arcuate form toward the front end of the carriage element 19 where they are supported to pivot about a horizontal axis at the pivot point 25. Because of this linkage to the carriage element 19, the compression bail 23 is displaced jointly with the movable support wall 20, whereby it will always be underneath the lower edge of the support wall 20. In order that the compression bail 23 remain at a spacing as constant as possible from the set-up surface 16, the guide bars 24 rest on the inside edge 26 of the cut-out 5. When advancing the carriage element 19, the guide bars 24 drag over this inside edge 26. As this inside edge 26 is a part of the housing and hence is fixed in place, while on the other hand the link point 25 moves jointly with the carriage element 19 and thereby changes not only its horizontal distance from the inside edge but also its height, the compression bail 23 regardless of the position of the movable support 20 retains its distance from the set-up surface 16, and this conservation of distance is further enhanced by the slightly arcuate shape of the guide bars 24 between the inside edge 26 and the link point 25. Accordingly, this geometry assures that the compression bail 23 is displaced extensively parallel to the set-up surface 16, whereby the covers set on it are always clamped at the same place, regardless of their thickness.

The carriage element 19 is displaceably guided on both sides by means of identical guide devices. The essential component of these guide devices, in each case, is a gear-rack guidance 27 consisting in each case of a rack 28 integrated in the bottom of the upwardly slanting housing section 6 and of a gear 29 rotatably supported in the carriage element 19. The racks 28 extend parallel to the top side 3 of the housing 2 in an upwardly slanting manner. The gears 29 rest from above on the particular, associated racks 28. The gears 29 located on both sides are mutually and rigidly joined by a shaft 30. As a result, the carriage element is prevented from slewing.

At the upper side, the carriage element 19 rests in each case against support rollers 31, 32, 33, 34. Two support rollers 32, 34 are pressed by a bar spring 35, 36 against the inside of the top side 3. As a result, when not being operated, the carriage element 19 will be pivoted downward about the gears 29 in the front region of the housing 2. In that area the carriage element 19 is provided with brake pads 37, by means of which the carriage element 19 rests on the inside wall of the upwardly slanting housing section for any position of the carriage element 19. Therefore, it cannot move by itself. If the carriage element 19 is to be displaced from the position shown toward the fixed support wall 13, only a slight downward pressure need be exerted in the region of the recess 22. In that case, the carriage element 19 will pivot against the action of the bar springs 35, 36 in the counterclockwise sense, whereby the brake pads 37 easily lift off and the carrigage element 19 is then displaced in problem-free manner. This process takes place anyway more or less automatically because a downward pressure is also applied in most instances when the carriage element 19 is displaced.

After the movable support wall 20 has been pressed against a cover standing on the set-up surface 16, the carriage element 19 is released again so that on account of the action of the bar springs 35, 36 it is now easily pivoted clockwise about the gears 29 whereby the brake pads 37 again come to rest. This pivoting motion is further enhanced by the reaction force from the cover, so that the braking by the brake pads 37 is correspondingly large and the cover is firmly held in position. However, this clockwise pivoting motion of the carriage element 19 is limited by the support rollers 31, 33. These are supported in rotational but otherwise fixed manner in the carriage element 19, their arrangement with respect to the gears 29 being slightly offset toward the support wall 20 and allowing only a restricted pivoting motion because of the resting against the inside of the top side 3 of the housing. The bar springs 35, 36 are wound about the support rollers 31, 33 with an end 38 of the bar springs 35, 36 directed toward the support walls 13, 20 pressing down the guide bar 24 to force it to always rest against the inside edge 26. As a result, an extremely precise guidance is achieved on the whole for the carriage element 19 and hence for the support wall 20, offering furthermore the advantage of self-locking which is easily and rapidly released in automatic manner when the carriage element 19 is displaced.

It is easily seen that the slanted guidance of the carriage element 19 and hence of the support wall 20 makes possible substantially easier insertion of a cover into the duct between the two support walls 13, 20 because the upper edge, which must be overcome, of the movable support wall 20 is substantially lower in the retracted position shown than the fixed support wall 13. Nevertheless, it is precisely the binding backs, which because of their thinness are less strong, that are well propped by the support walls 13, 20 because the height of the upper edge of the support wall 20 following the clamping of the cover will practically be at the same height as the fixed support wall 13, the compression bail 23 assuring additional stability. The binding equipment 1 of the invention thereby is characterized by especially simple handling, both as regards the insertion of a binding back and easy displacement of the carriage element 9 by means of its precise guidance.

I claim:

1. Binding equipment for binding loose sheets in covers provided at their backs with a thermoplastic adhesive, including a frame comprising two mutually spaced and parallel support walls of which one is connected to a carriage element displaceable within the frame, a set-up surface being mounted underneath the displacement region of the movable support wall and being provided with a heater, characterized in that carriage element (19) rests on a displacement plane slanting upward toward the support walls (13, 20).

2. Binding equipment per claim 1, characterized in that the sloping angle of the displacement plane is between 15° and 45° with respect to the horizontal.

3. Binding equipment per claim 2, characterized in that the sloping angle of the displacement plane is between 20° and 30° with respect to the horizontal.

4. Binding equipment per claim 1, characterized in that the height of the upper edge of the displaceable support wall (20) when resting against the fixed support wall (13) is approximately the same as that of latter's upper edge.

5. Binding equipment per claim 1, characterized in that a compression element (23) is displaceably guided at the carriage element (19) and has a lower side which is nearly above the set-up surface (16) and parallel to and below the displaceable support wall (20), and in that this compression element (23) is so guided at the carriage element (19) that when this carriage element (19), i.e. the movable support wall (20) is displaced, this compression element (23) will move by its lower side parallel to and hence at a constant spacing from the set-up surface (16).

6. Binding equipment per claim 5, characterized in that the compression element is designed to be a compression bail (23) supported on both sides in pivoting manner by means of guide bars (24) at the carriage element (19).

7. Binding equipment per claim 6, characterized in that the rest for each guide bar (24) consists of a raised and rigid housing edge (26) or of a roller and in that the guide bars (24) are bent slightly upwards.

8. Binding equipment per claim 6, characterized in that the guide bars (24) each are provided at the lower side with a projection that in the fully retracted position of the movable support wall (20) will run on the rest means (26) of said bars.

9. Binding equipment per claim 6, characterized in that the guide bars (24) are loaded by a downward-acting spring (34, 35, 37).

10. Binding equipment per claim 1, characterized in that the carriage element (19) is guided through at least one gear-rack guidance (27, 28, 29) consisting in each case of one rack (28) extending in the direciton of displacement and of at least one meshing gear (29).

11. Binding equipment per claim 10, characterized in that the rack and the gear are very wide and are mounted centrally.

12. Binding equipment per claim 10, characterized in that one gear-rack guidance (27) is mounted on both sides of the carriage element (19) and in that in each case two gears (29) are supported pairwise at the same height and are rigidly joined together.

13. Binding equipment per claim 10, characterized in that the gear-rack(s) (28) is (are) fixed in place and in that the gear(s) (29) rest(s) in the carriage element (19).

14. Binding equipment per claim 10, characterized in that the gear-rack guide(s) (27) is (are) mounted to the lower side of the carriage element (19).

15. Binding equipment per claim 14, characterized in that at least one support roller (31, 33) is provided to prop the carriage element (19) against downward tipping of the part on the side of the support wall, where said roller runs on a support track parallel to the plane of displacement.

16. Binding equipment per claim 15, characterized in that at least one support roller (31, 33) and one support track are provided on each of the two sides of the carriage element (19).

17. Binding equipment per claim 15, characterized in that two support rollers (30, 31, 32, 33) are provided both in front and behind the particular gear (29) as seen in the direction of displacement.

18. Binding equipment per claim 14, characterized in that the support roller(s) (31, 33) is (are) spring-supported and in that the carriage element (19) in the presence of the unhampered action of the spring-loaded support roller(s) (31, 33) rests by means of at least one brake means (36) against a housing part (4).

19. Binding equipment per claim 17, characterized in that the support roller(s) (31, 33) is (are) mounted to the top side and in that the brake element(s) (36) is (are) mounted to the lower side of the carriage element (19) and in each case in the front region of this carriage element.

20. Binding equipment per claim 18, characterized in that the support roller(s) (30, 31, 32, 33) is (are) all mounted on the top side or the lower side.

* * * * *